US008046920B2

(12) United States Patent
Nakasuka

(10) Patent No.: US 8,046,920 B2
(45) Date of Patent: Nov. 1, 2011

(54) RAZOR

(75) Inventor: Hiroyuki Nakasuka, Seki (JP)

(73) Assignee: Kai R&D Center Co., Ltd., Gifu-ken (JP)

( * ) Notice: Subject to any disclaimer, the term of this patent is extended or adjusted under 35 U.S.C. 154(b) by 481 days.

(21) Appl. No.: 12/223,870

(22) PCT Filed: Feb. 14, 2007

(86) PCT No.: PCT/JP2007/052559
§ 371 (c)(1),
(2), (4) Date: Aug. 12, 2008

(87) PCT Pub. No.: WO2007/094336
PCT Pub. Date: Aug. 23, 2007

(65) Prior Publication Data

US 2010/0229397 A1 Sep. 16, 2010

(30) Foreign Application Priority Data

Feb. 14, 2006 (JP) ..... 2006-036664

(51) Int. Cl.
*B26B 21/00* (2006.01)

(52) U.S. Cl. ..... 30/50

(58) Field of Classification Search ..... 30/47, 50–64, 30/75, 84
See application file for complete search history.

(56) References Cited

U.S. PATENT DOCUMENTS 3,940,853 A 3/1976 Francis
4,200,976 A 5/1980 Gooding
4,324,041 A * 4/1982 Trotta ..... 30/47
4,337,575 A * 7/1982 Trotta ..... 30/47
(Continued)

FOREIGN PATENT DOCUMENTS

EP 0858869 8/1998
(Continued)

OTHER PUBLICATIONS

European Search Report issued by the European Patent Office on Feb. 24, 2010 in connection with corresponding European patent application No. 07714137.2-2313 (and English translation).

(Continued)

*Primary Examiner* — Jason Daniel Prone
(74) *Attorney, Agent, or Firm* — Posz Law Group, PLC

(57) ABSTRACT

A razor is provided with a blade member 3 having a base and a blade body 4 on the base, a blade base member 5 arranged on the bottom side of the razor head 2, and a top member 6 arranged on the top side of the razor head 2. The blade member 3 is fitted between the blade base member 5 and the top member 6. The base is supported on the blade base member 5. A cutting edge 4*a* of the blade body 4 is exposed at the top member 6. The base is elastically supported by the leaf spring so as to move integrally against a pressing force from the skin surface when the blade body is caused to contact the skin surface. A contact pressure of the blade body 4 on the skin surface is restricted, thereby improving the shaving performance. Further, since a single-component blade member 3 having the blade body 4 on the base is fitted between the blade base member 5 and the top member 6, this simplifies the structure for elastically supporting the blade body 4 and allowing the blade body 4 to move.

7 Claims, 7 Drawing Sheets

U.S. PATENT DOCUMENTS

| | | | | |
|---|---|---|---|---|
| 4,403,412 | A * | 9/1983 | Trotta | 30/47 |
| 4,403,413 | A * | 9/1983 | Trotta | 30/47 |
| 4,516,321 | A | 5/1985 | Francis | |
| 4,709,477 | A * | 12/1987 | Ferraro | 30/50 |
| 4,774,765 | A * | 10/1988 | Ferraro | 30/50 |
| 5,070,612 | A * | 12/1991 | Abatemarco | 30/50 |
| 5,074,042 | A | 12/1991 | Althaus et al. | |
| 5,222,300 | A | 6/1993 | Althaus et al. | |
| 5,251,376 | A * | 10/1993 | Althaus et al. | 30/50 |
| 5,253,420 | A | 10/1993 | Althaus et al. | |
| 5,365,665 | A | 11/1994 | Coffin | |
| 5,377,409 | A * | 1/1995 | Chen | 30/50 |
| 5,416,974 | A | 5/1995 | Wain | |
| 5,546,660 | A | 8/1996 | Burout et al. | |
| 6,295,734 | B1 * | 10/2001 | Gilder et al. | 30/50 |
| 6,397,473 | B1 * | 6/2002 | Clark | 30/50 |
| 6,671,961 | B1 * | 1/2004 | Santhagens Van Eibergen et al. | 30/50 |
| 6,877,227 | B2 * | 4/2005 | Van Eibergen et al. | 30/50 |
| 7,191,523 | B2 | 3/2007 | Miyazaki et al. | |
| 7,621,203 | B2 | 11/2009 | Aviza | |
| 7,676,929 | B2 | 3/2010 | Lembke et al. | |
| 7,877,879 | B2 | 2/2011 | Nakasuka | |
| 2003/0046819 | A1 | 3/2003 | Ferraro et al. | |
| 2003/0159291 | A1 * | 8/2003 | Clark | 30/50 |
| 2003/0217472 | A1 * | 11/2003 | Follo | 30/50 |
| 2004/0020053 | A1 * | 2/2004 | Wain | 30/50 |
| 2004/0118250 | A1 * | 6/2004 | White et al. | 30/50 |
| 2004/0168322 | A1 * | 9/2004 | Richard | 30/50 |
| 2004/0216310 | A1 | 11/2004 | Santhagens Van Eibergen | |
| 2004/0255467 | A1 * | 12/2004 | Lembke et al. | 30/50 |
| 2005/0172495 | A1 * | 8/2005 | Pennella | 30/50 |
| 2006/0032056 | A1 * | 2/2006 | Coffin et al. | 30/50 |
| 2007/0151106 | A1 * | 7/2007 | Steunenberg et al. | 30/50 |
| 2007/0256303 | A1 * | 11/2007 | Lembke et al. | 30/50 |
| 2008/0066315 | A1 * | 3/2008 | Xu | 30/50 |
| 2008/0250646 | A1 * | 10/2008 | Nakasuka | 30/34.05 |
| 2008/0256800 | A1 * | 10/2008 | Nicoll | 30/50 |
| 2009/0113716 | A1 * | 5/2009 | Wain et al. | 30/50 |
| 2009/0260238 | A1 * | 10/2009 | Nakasuka | 30/527 |
| 2009/0307908 | A1 * | 12/2009 | Nakasuka | 30/41 |
| 2010/0077617 | A1 | 4/2010 | Peterson et al. | |
| 2010/0154220 | A1 * | 6/2010 | Nakasuka | 30/41.6 |
| 2010/0154222 | A1 * | 6/2010 | Nakasuka | 30/50 |

FOREIGN PATENT DOCUMENTS

| | | | |
|---|---|---|---|
| EP | 1 985 418 | | 10/2008 |
| EP | 1 990 142 | | 11/2008 |
| EP | 1 990 143 | | 11/2008 |
| EP | 2 078 593 | | 7/2009 |
| EP | 1718438 | | 9/2009 |
| JP | U-60-47469 | | 4/1985 |
| JP | A-04-361782 | | 12/1992 |
| JP | A-04-361783 | | 12/1992 |
| JP | A-05-000191 | | 1/1993 |
| JP | A-05-000192 | | 1/1993 |
| JP | A-05-184739 | | 7/1993 |
| JP | A-05-184740 | | 7/1993 |
| JP | A-05-184741 | | 7/1993 |
| JP | A-06-047174 | | 2/1994 |
| JP | A-06-126046 | | 5/1994 |
| JP | A-10-258190 | | 9/1998 |
| JP | A-10-263220 | | 10/1998 |
| JP | A-2000-262777 | | 9/2000 |
| JP | A-2001-079281 | | 3/2001 |
| JP | A-P2001-334079 | | 12/2001 |
| JP | A-2003-220285 | | 8/2003 |
| JP | A-2005-161066 | | 6/2005 |
| WO | WO 84/02303 | | 6/1984 |
| WO | WO 88/09710 | | 12/1988 |
| WO | WO 91/14546 | | 10/1991 |
| WO | WO 91/19597 | | 12/1991 |
| WO | WO 93/01917 | | 2/1993 |
| WO | WO 94/11163 | | 5/1994 |
| WO | WO 96/10472 | | 4/1996 |
| WO | WO 96/29183 | | 9/1996 |
| WO | WO 96/32233 | | 10/1996 |
| WO | WO 98/05478 | | 2/1998 |
| WO | WO 98/35795 | | 8/1998 |
| WO | WO 01/39937 | | 6/2001 |
| WO | WO 03/064119 | | 8/2003 |
| WO | WO 2004/073939 | | 9/2004 |
| WO | WO 2007029552 | A1 * | 3/2007 |
| WO | WO 2007029553 | A1 * | 3/2007 |
| WO | WO 2007/094335 | | 8/2007 |
| WO | WO 2007/094337 | | 8/2007 |
| WO | WO 2007094336 | A1 * | 8/2007 |

OTHER PUBLICATIONS

European Search Report issued by the European Patent Office on Feb. 25, 2010 in connection with corresponding European patent application No. 07708364.0-2313 (and English translation), which corresponds to related U.S. Appl. No. 12/223,873.

European Search Report issued by the European Patent Office on Feb. 24, 2010 in connection with corresponding European patent application No. 07714136.4-2313 (and English translation), which corresponds to related U.S. Appl. No. 12/223,872.

Office Action issued from the U.S. Patent and Trademark Office on Jan. 12, 2011 for related U.S. Appl. No. 12/223,872.

Notification of Transmittal of Translation of the International Search Report on Patentability dated Aug. 28, 2008 in corresponding PCT application No. PCT/JP2007/052560.

Notification of Transmittal of Translation of the International Search Report on Patentability dated Aug. 28, 2008 in corresponding PCT application No. PCT/JP2007/052558.

Notification of Transmittal of Translation of the International Search Report on Patentability dated Aug. 28, 2008 in corresponding PCT application No. PCT/JP2007/052559.

First Office Action issued from the U.S. Patent and Trademark Office on Nov. 23, 2010 for the related U.S. Appl. No. 12/223,873.

"Laser Welding", http://www.sanpo-pub.co.jp/omoshiro/freshman/post_388.html, printed on Jan. 6, 2006 (4 pages total including an English translation of webpage excerpt).

"Ionization Tendency," http://www.max.hi-ho.ne.jp/lylle/denchi2.html printed on Jan. 5, 2006 (3 pages total including an English translation of webpage excerpt).

PCT International Search Report mailed on May 15, 2007 for the corresponding International patent application No. PCT/JP2007/052559.

Notice of Allowance issued from the U.S. Patent and Trademark Office on Apr. 12, 2011 for related U.S. Appl. No. 12/223,873.

Office Action issued from the U.S. Patent and Trademark Office on Jul. 13, 2011 for the related U.S. Appl. No. 12/223,872 (copy enclosed).

* cited by examiner 28c
28b
3
28a
28
6
28d 26c
26
26b
23
26a
5b
6
26d 2
5
6
3
30
24c
28c
28a
31
24a
44
24
24b
24d 5b
5a
28b
28c
28
28a
3
6
5
2
24d
28d

RAZOR

CROSS REFERENCE TO RELATED APPLICATIONS

This application is a U.S. national stage application of PCT/JP2007/052559 filed on Feb. 14, 2007, and claims priority to, and incorporates by reference, Japanese Patent Application No. 2006-036664 filed on Feb. 14, 2006. This application is related to concurrently filed U.S. application Ser. No. 12/223,872, entitled "RAZOR", which is a U.S. national stage application of PCT Application No. PCT/JP2007/052558 filed on Feb. 14, 2007, and concurrently filed U.S. application Ser. No. 12/223,873, entitled "RAZOR", which is a U.S. national stage application of PCT Application No. PCT/JP2007/052560 filed on Feb. 14, 2007.

FIELD OF THE INVENTION

The present invention relates to a structure for supporting a blade body in a razor head in a razor provided with the razor head having the blade body.

BACKGROUND OF THE INVENTION

As disclosed in Japanese Patent No. 2963824, a movable blade-body type safety razor is provided with a frame body made up of a front guard, a pair of side frame portions, and a back frame portion on a blade base. Inside the frame body, arranged are a plurality of elastic arms and a plurality of blade-body placing portions connected thereto. Of these blade-body placing portions, a front blade body is arranged on a blade-body placing portion on the front side, whereas a back blade body is arranged on a blade-body placing portion on the back side. Both blade bodies are arranged inside the frame body and also held between a holding portion disposed on a top plate and the blade-body placing portions. Therefore, both blade bodies are elastically supported on the blade base so as to be movable together with the top plate and each of the blade-body placing portions and also by each of the elastic arms.

In the structure for supporting the blade body disclosed in Japanese Patent No. 2963824, each of the blade bodies is held between each of blade-body placing portions connected to each of elastic arms and a holding portion of the top plate inside a frame body. It is, therefore, troublesome to form each of the elastic arms and each of the blade body placing portions. Also, there is another problem of making the razor complicated in structure due to a mechanism for allowing the top plate to move together with the blade body. Further, according to the above structure, the blade body is elastically supported so as to be movable against a frictional force developed on movement of the razor head along the skin surface. However, there is a problem that the blade body does not move only by causing the blade body to contact the skin surface, thus resulting in a poor shaving performance.

SUMMARY OF THE INVENTION

An objective of the present invention is to provide a razor which is improved in shaving performance and simplified in structure for elastically supporting a blade body so as to be movable.

In order to solve the above problem, according to a first aspect of the present invention, a razor including a razor head having a blade body is provided. The razor includes a blade member having a base and the blade body on the base, a blade base member arranged on the bottom side of the razor head, and a top member arranged on the top side of the razor head. The blade member is fitted between the blade base member and the top member. The cutting edge of the blade body is exposed in the top member. The base is elastically supported on the blade base member so as to be movable against a pressing force received from the skin surface when the blade body is caused to contact the skin surface.

According to the above configuration, a contact pressure of the blade body on the skin surface is restricted, thereby improving the shaving performance. Further, a single-component blade member having the blade body on the base is fitted between the blade base member and the top member. Therefore, the structure for movably and elastically supporting the blade body is simplified. The single component blade member includes not only that in which the blade body is attached to the base by welding or others but also that in which the blade body and the base are formed integrally. In other words, it means a blade member disposed in separation from the blade base member and the top member.

In order to solve the above problem, according to a second aspect of the present invention, a razor including a razor head having a plurality of blade bodies is provided. A blade member includes a base. The blade bodies attached to the base are supported on a blade base member arranged on the bottom side of the razor head. A skin surface contact portion that contacts the skin surface together with the cutting edges of the blade bodies is disposed on the surface of the razor head, each of the blade bodies is arranged on the base along a front-back direction orthogonal to a longitudinal direction of the blade bodies. The base is elastically supported on the blade base member so as to move integrally against a pressing force from the skin surface when blade bodies are caused to contact the skin surface. In this instance, a contact pressure of each of the blade bodies on the skin surface is restricted, thereby improving the shaving performance. It is also possible to easily simplify a structure for supporting each of the blade bodies so as to move together with the base.

It is preferable that the above razor is provided with a front skin surface contact portion located on the front side of the cutting edge and a back skin surface contact portion located on the back side of the cutting edge in the front-back direction orthogonal to the longitudinal direction of the blade body, and the base is movable in a direction orthogonal to a plane including the front and back skin surface contact portions. In this instance, a contact pressure of the blade body on the skin surface is reliably restricted, thereby further improving the shaving performance.

It is preferable that in the above razor, the base is provided with a placing base placed on the blade base member and a blade body supporting portion constructed between a pair of placing bodies forming the placing base, and an elastic body is disposed on both placing bodies.

It is preferable that in the above razor, the elastic body is a spring, and the blade body supporting portion is made integrally with the elastic body.

It is preferable that in the above razor, the elastic body is a leaf spring.

In these instances, the blade member is simplified in structure.

It is preferable that in the above razor, the blade body supporting portion is provided with a plurality of blade body attaching portions arranged in a staircase pattern in the front-back direction, each of the blade bodies is movable integrally together with each of the blade body attaching portions to which the blade body is attached. In this instance, the structure for supporting each blade body in which each blade body can move at the same time is simplified.

It is preferable that in the above razor, the leaf spring is provided with a leg portion which is placed on the blade base member, and a space is provided between leaf springs and the blade base member. In this instance, the leaf spring can be simplified in structure.

It is preferable that in the above razor, the blade body is attached to the blade body supporting portion by welding. In this instance, the blade body can be attached easily to the blade body supporting portion.

It is preferable that in the above razor, the blade base member is provided with a base plate on which the base is placed, and the base plate is made of a metal higher in ionization tendency than the base or the blade body. In this instance, the base plate is oxidized earlier than the blade body, thereby preventing the blade body from being rusted.

It is preferable that in the above razor, the blade body is attached to the blade body supporting portion between both elastic bodies.

It is preferable that in the above razor, the elastic body is arranged between the blade base member and the top member. In this instance, the blade member can be simplified in structure.

BRIEF DESCRIPTION OF THE DRAWINGS

FIG. 1(*b*) is a perspective view of the oscillating razor, as viewed from the front side;

FIG. 3(*b*) is a perspective view of a blade base member;

FIG. 3(*c*) is a perspective view showing a state in which the blade member is arranged on the blade base member;

FIG. 4(*b*) is a perspective view showing a state in which the blade member and the base plate are fitted into the top member;

FIG. 4(*c*) is a perspective view of the razor head, as viewed from above;

FIG. 4(*d*) is a perspective view of the razor head, as viewed from below;

FIG. 5(*b*) is a cross-sectional view taken along line 5*b*-5*b* in FIG. 4(*d*);

FIG. 6(*b*) is a bottom view of FIG. 6(*a*);

FIG. 7(*b*) is an enlarged partial side elevational view showing the arm portion of the shaving aid member;

FIG. 8(*b*) is a partial side elevational view;

FIG. 9(*b*) is an enlarged partial cross-sectional view showing a connecting part of supporting arms of the holder with the razor head.

DETAILED DESCRIPTION OF THE PREFERRED EMBODIMENTS

Figure 5A:
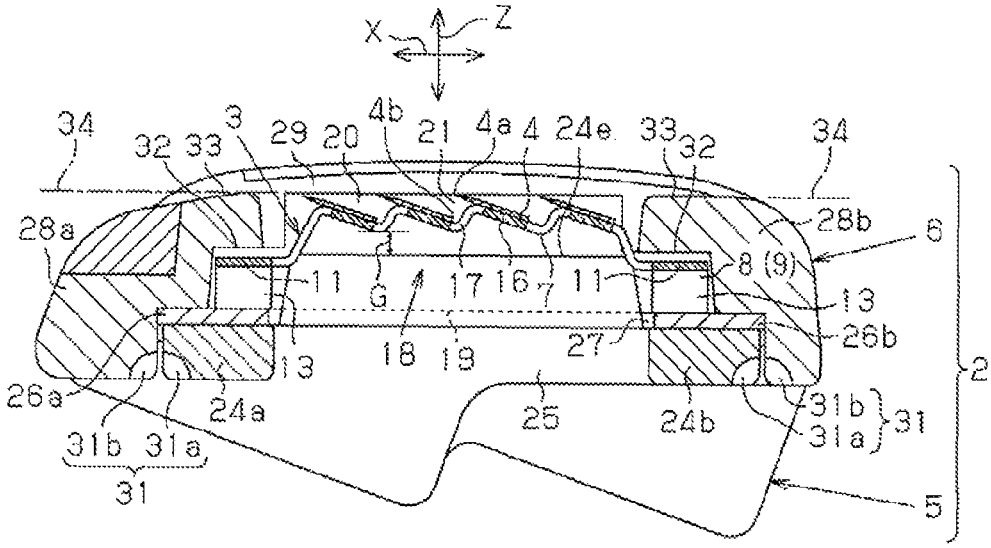
FIG. 5(*a*) is a cross-sectional view taken along line 5*a*-5*a* in FIG. 4(*d*)
Figure 5B:
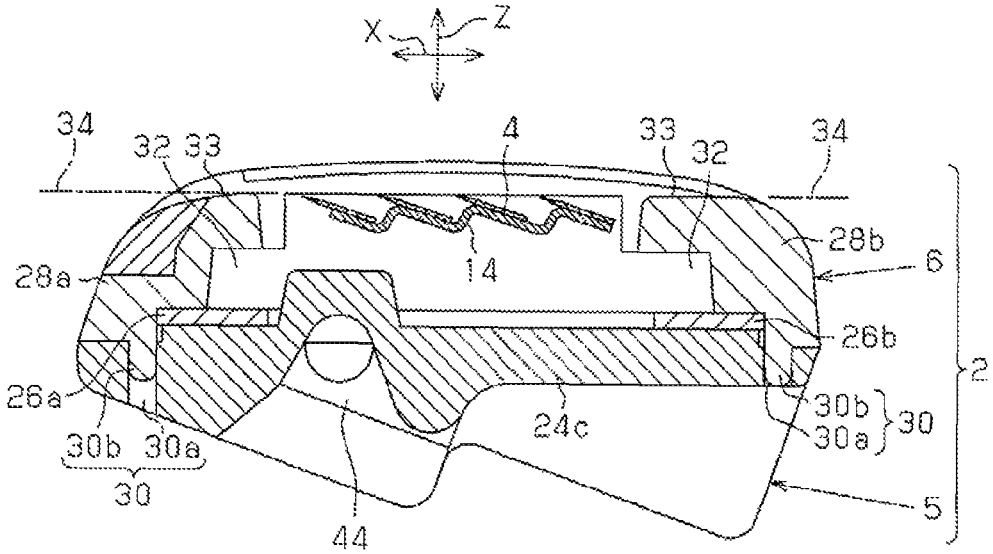
Figure 6A:
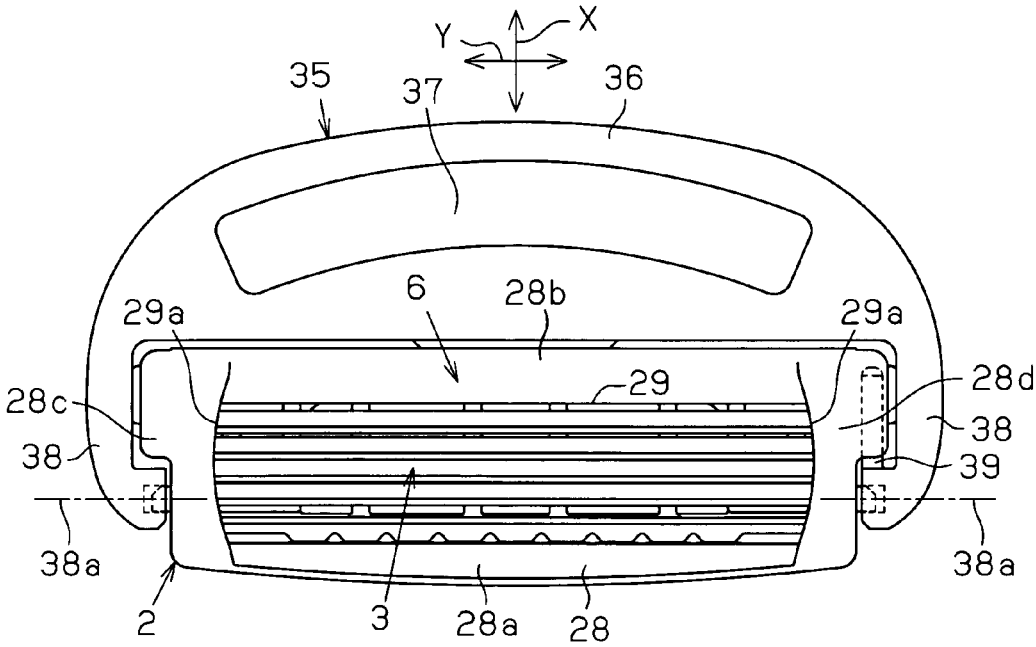
FIG. 6(*a*) is a front elevational view showing a state in which a shaving aid member is mounted on the razor head.
Figure 6B:
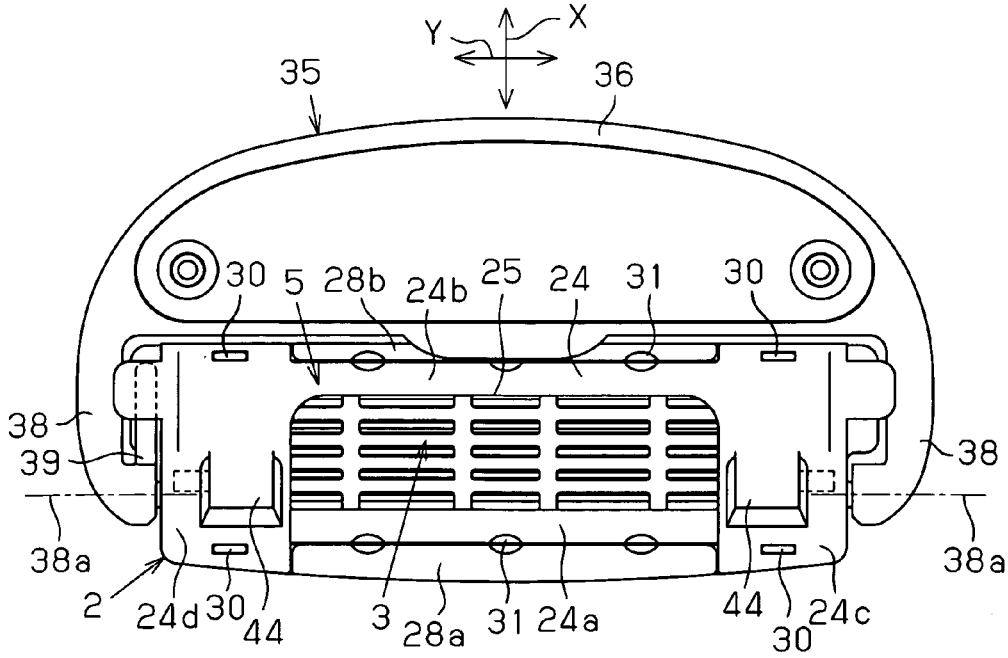

Hereinafter, a description will be given of an embodiment of the present invention by referring to drawings. In explaining a razor of the present invention, X, Y, Z directions will be defined as shown in FIGS. 5 and 6.

Figure 1:
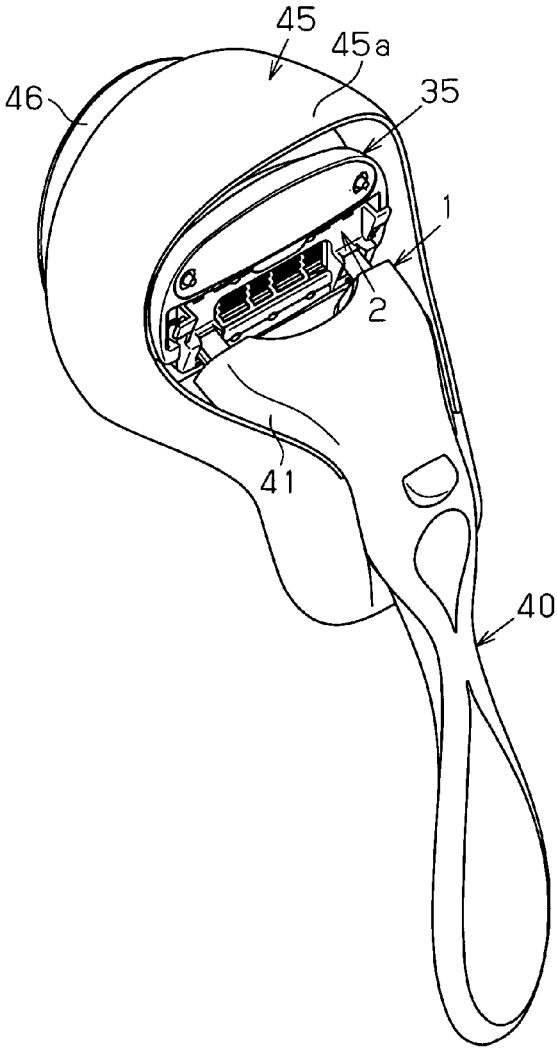
FIG. 1(*a*) is a perspective view of an oscillating razor of the present embodiment retained on a hook, as viewed from the bottom side.
Figure 1:
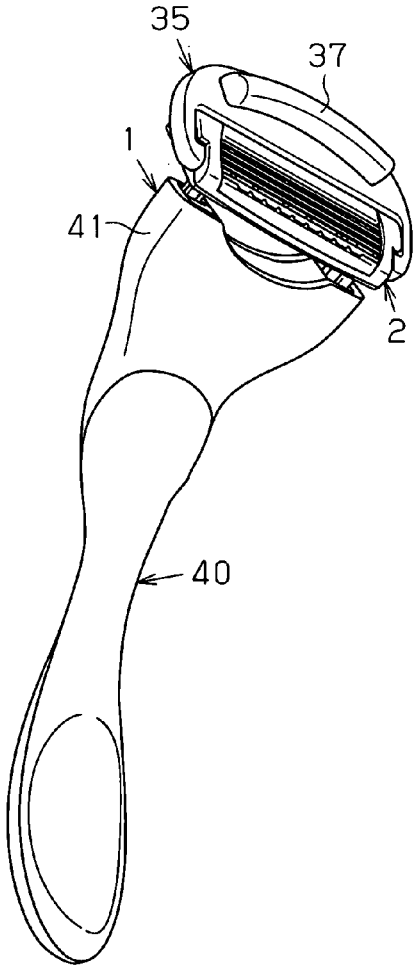

As shown in FIG. 1, an oscillating razor 1 is provided with a razor head 2.

Figure 2:
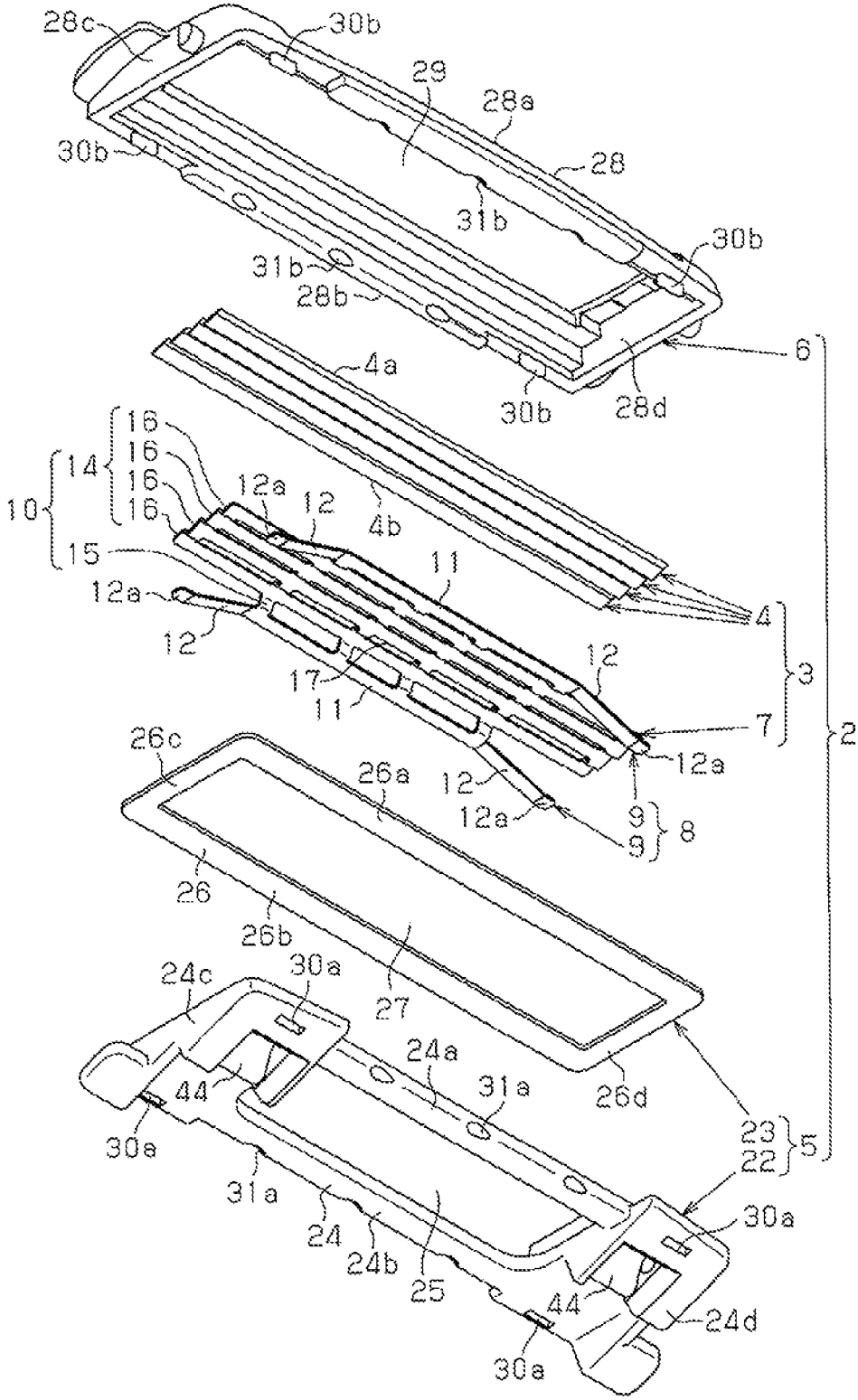
FIG. 2 is an exploded perspective view of a razor head of the oscillating razor.

As shown in FIG. 2, the razor head 2 is provided with a blade member 3 made up of four blade bodies 4 and a base 7, a blade base member 5 arranged on the bottom side of the razor head 2, and a top member 6 arranged on the top side of the razor head 2. The blade body 4 is made of a metal such as martensite stainless steel. The thickness of the blade body 4 is set, for example, in a range between 0.05 mm and 0.3 mm, inclusive.

The base 7 is made of a metal such as austenite stainless steel. The base 7 is formed, for example, by press-working a metal plate having a thickness of 0.1 mm to 0.5 mm. The base 7 is provided with a placing base 8 as a placing body made up of a pair of leaf springs 9 and a blade body supporting portion 10 installed between the leaf springs 9. In the present embodiment, the placing body is a supporting edge portion disposed at both side edges of the base 7. Each of the leaf springs 9 is provided with a supporting plate 11 extending in the longitudinal direction (Y direction given in FIG. 6) of the blade body 4 and a leg plate 12 as a leg portion which is bent from both end portions of the supporting plate 11 to the blade base member 5. A deflection allowance space 13 is disposed between the supporting plate 11 and both leg plates 12 (refer to FIG. 5(*a*)). The base 7 is about 9 mm in width and about 34 mm in the entire length.

The blade body supporting portion 10 is made up of a blade body attaching plate 14 as a blade body attaching portion having four step plates 16 and a plurality of installed arm portions 15 projected downward from both side edges of the blade body attaching plate 14. Each of the step plates 16 is extended in the Y direction and also arranged in a staircase pattern along the front-back direction (the X direction in FIGS. 5(*a*) and 5(*b*)) orthogonal to the Y direction. A plurality of through holes 17 extending in the Y direction are disposed between adjacent step plates 16. Each of the through holes 17 is arranged in the Y direction. With the strength of the base 7 taken into account, the closer to the center of the base 7, the shorter the entire length of the through holes 17 becomes. Each of the installed arm portions 15 is disposed in the Y direction at both side edge portions of the blade body attaching plate 14. Each of the installed arm portions 15 is bent toward the supporting plate 11 at the end portion thereof and also formed integrally with the supporting plate 11. Therefore, a space is formed inside the blade body attaching plate 14.

As shown in FIG. 5(*a*), a debris discharge hole 18 is disposed inside the placing base 8. The debris discharge hole 18 is opened outside the placing base 8 via a bottom opening 19 disposed on the bottom side of the placing base 8 and a top opening 20 disposed on the top side of the placing base 8. The bottom opening 19 is on a plane including both end portions 12*a* of each of leg plates 12, and a space enclosed by four end portions 12*a* of both leg plates 12 (refer to FIG. 2). The top opening 20 is a space located outside each through hole 17 of the blade body attaching plate 14 as well as both side edges and both end portions of the blade body attaching plate 14. Further, the debris discharge hole 18 is opened outside the placing base 8 at both side edges and both end portions of the placing base 8 as well.

The blade body 4 extending in the Y direction is placed on each of the step plates 16 and attached thereto by laser welding. Each of the blade bodies 4 is attached to each of the step plates 16, thereby arranged in a staircase pattern on the blade body attaching plate 14. A cutting edge 4*a* of each blade body 4 is projected forward from each of the step plates 16. Regarding any adjacent pair of blade bodies 4, the cutting edge 4*a* of the blade body 4 on the back side is closely spaced apart from a back edge portion 4*b* of the blade body 4 on the front side. Therefore, a clearance 21 is formed between adjacent blade bodies 4. The clearance 21 faces each of the through holes 17 on the blade body attaching plate 14.

Figure 3A:
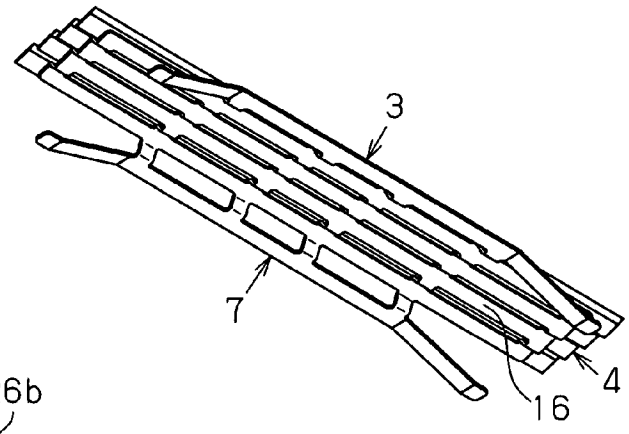
FIG. 3(*a*) is a perspective view of a blade member.
Figure 3B:
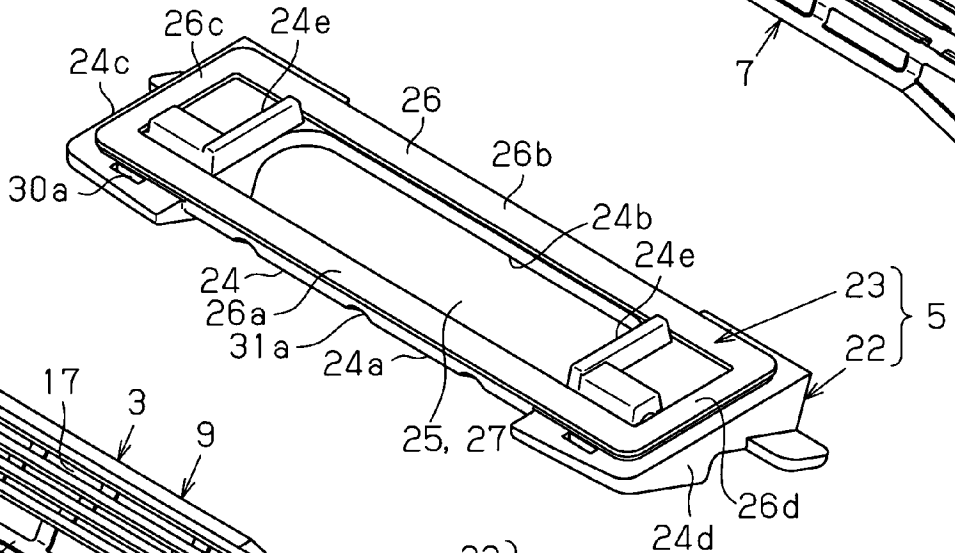
Figure 3C:
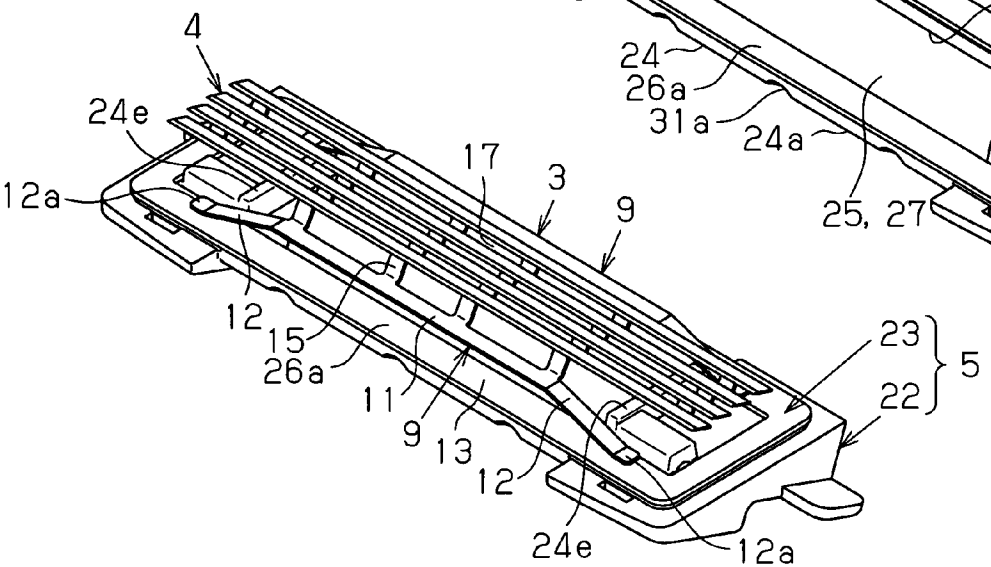

As shown in FIGS. 2 and 3, the blade base member 5 is made up of a bottom base 22 and a base plate 23 arranged on the bottom base 22. The bottom base 22 is made of plastic and the base plate 23 is made of aluminum. The thickness of the base plate 23 is about 0.3 mm. The bottom base 22 is provided with a debris discharge hole 25 inside a frame portion 24. The frame portion 24 is made up of a front frame portion 24*a*, a back frame portion 24*b*, a left frame portion 24*c*, and right frame portion 24*d* as edge portions. Stoppers 24*e* projecting toward the blade body attaching plate 14 are disposed respectively at the inner edges of the left frame portion 24*c* and the right frame portion 24*d*. The base plate 23 is provided with a through hole 27 as a debris discharge hole inside a frame portion 26. The frame portion 26 is made up of a front frame portion 26*a*, a back frame portion 26*b*, a left frame portion 26*c*, and a right frame portion 26*d*. In a state where the base plate 23 is arranged on the bottom base 22, the frame portion 26 of the base plate 23 is superimposed on the frame portion 24 of the bottom base 22, and the through hole 27 of the base plate 23 is superimposed on the debris discharge hole 25 of the bottom base 22.

The top member 6 is made of plastic. The top member 6 is provided with a blade body exposure hole 29 inside a frame portion 28. The frame portion 28 is made up of a front frame portion 28*a*, a back frame portion 28*b*, a left frame portion 28*c*, and a right frame portion 28*d* as edge portions. As shown in FIG. 6(*a*), an inner wall 29*a* closer to both end portions of the top member 6 is formed along a circular arc expanding outwardly. A shaving aid is attached to the front frame portion 28*a*.

As shown in FIG. 2, a plurality of positioning recesses 30*a* is disposed in the vicinity of both end portions of the bottom base 2. Further, a plurality of notches 31*a* is disposed on the front and back frame portions 24*a*, 24*b* of the bottom base 2. On the other hand, a plurality of positioning projections 30*b* to be engaged with each of the positioning recesses 30*a* is disposed in the vicinity of both end portions of the top member 6. Further, a notch 31*b* is disposed at a position facing each notch 31*a* at the front and back frame portions 28*a*, 28*b* of the top member 6. When the blade member 3 is fitted between the blade base member 5 and the top member 6, the frame portion 24 of the blade base member 5 and the frame portion 28 of the top member 6 are superimposed on each other. In this instance, the positioning projections 30*b* engage with the positioning recesses 30*a*, by which the front and back frame portions 24*a*, 24*b* of the blade base member 5 are positioned with respect to the front and back frame portions 28*a*, 28*b* of the top member 6. In this instance as well, as shown in FIG. 5(*a*), each of the notches 31*a* of the blade base member 5 is in alignment with each of the notches 31*b* of the top member 6 to form a plurality of attachment holes 31. Then, an instant adhesive agent is poured into the attachment holes 31, by which the blade base member 5 is bonded to the top member 6.

The leaf springs 9 on the base 7 are placed on the front and back frame portions 26*a*, 26*b* on the base plate 23 of the blade base member 5 at both end portions of the leg plate 12. Further, the leaf springs 9 are arranged at clearances 32 between the front and back frame portions 24*a*, 24*b* of the bottom base 22 and the front and back frame portions 28*a*, 28*b* of the top member 6. Both end portions of each blade body 4 are arranged between the left and right frame portions 24*c*, 24*d* of the bottom base 22 and the left and right frame portions 28*c*, 28*d* of the top member 6 on the blade body supporting portion 10. Both end portions of each blade body 4 are pressed to the left and right frame portions 28*c*, 28*d* of the top member 6 by an elastic force of each of the leaf springs 9. The cutting edge 4*a* of each blade body 4 is in close proximity to a shaving tangential plane 34 including each of skin-surface contact portions 33 disposed on the front and back frame portions 28*a*, 28*b* of the top member 6. Further, a plane including the cutting edge 4*a* and the back edge portion 4*b* of each blade body 4 is inclined with respect to the shaving tangential plane 34. Each blade body 4 is movable against an elastic force of each of the leaf springs 9 in the Z direction orthogonal to the shaving tangential plane 34, together with the blade body supporting portion 10.

On the base 7, the debris discharge hole 18 inside the placing base 8 communicates with the through hole 27 of the base plate 23 and the debris discharge hole 25 of the bottom base 22 via the back opening 19, and also communicates with the blade body exposure hole 29 of the top member 6 via the front opening 20.

Figures 4A, 4B, 4C, 4D:
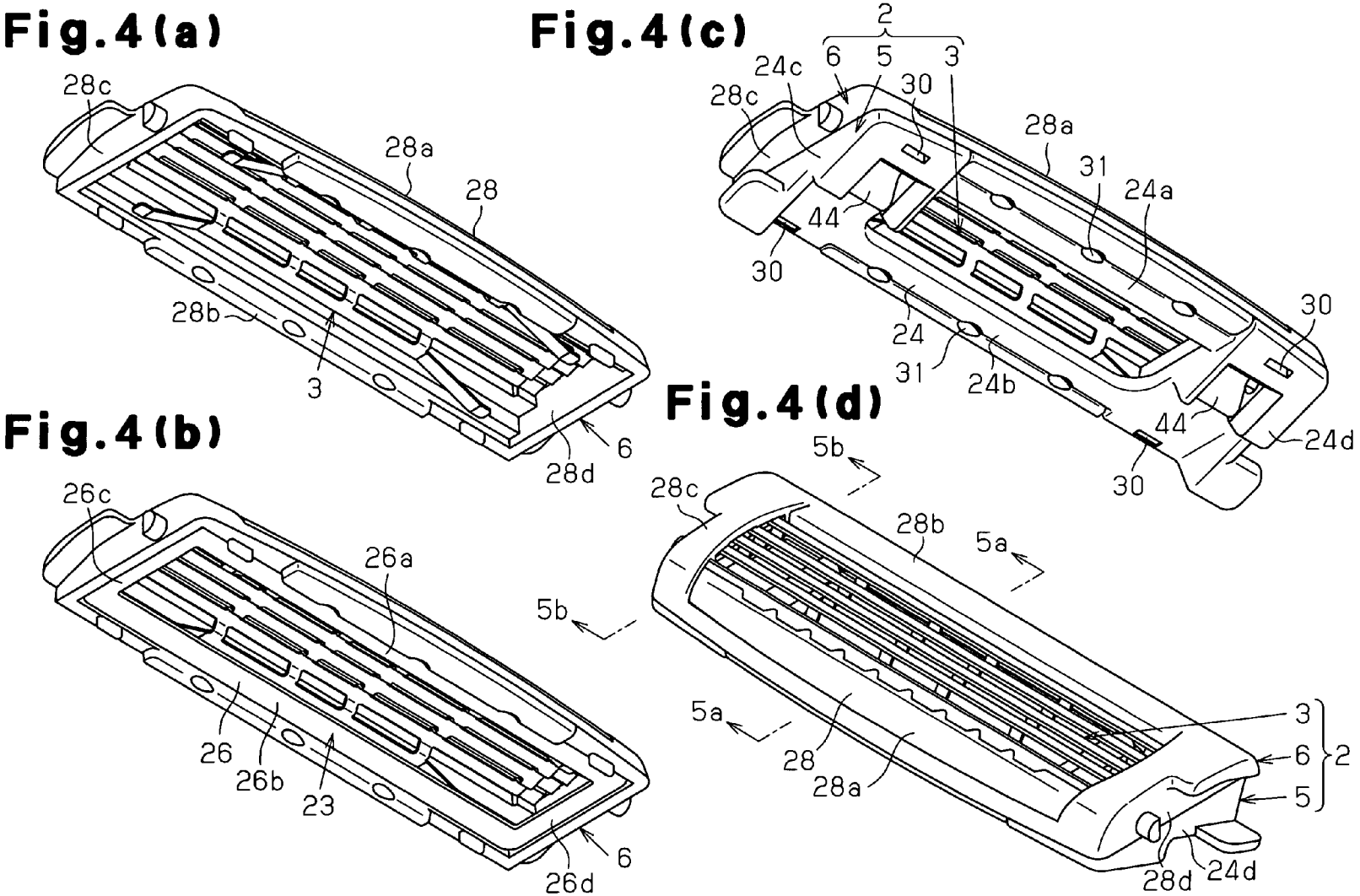
FIG. 4(*a*) is a perspective view showing a state in which the blade member is fitted into a top member.

When assembling the top member 6, the blade member 3, and the blade base member 5, first, as shown in FIG. 4(*a*), the blade member 3 is arranged inside the top member 6. Thereafter, as shown in FIG. 4(*b*), the base plate 23 is arranged so as to be superimposed on the blade member 3 inside the top member 6. Then, as shown in FIG. 4(*c*), the bottom base 22 is superimposed on the base plate 23 to assemble each of these members integrally.

Figure 7A:
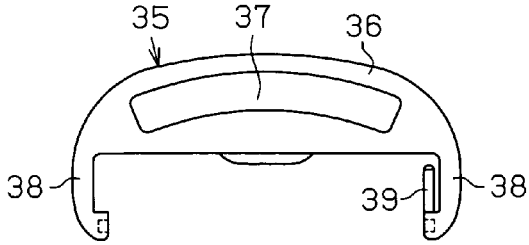
FIG. 7(*a*) is a front elevational view of the shaving aid member.
Figure 7B:
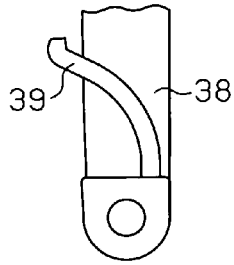

As shown in FIGS. 7(*a*) and 7(*b*), the shaving aid member 35 is provided with a base member 36 made of plastic, and a shaving aid 37 (for example, a porous body such as sponge soaked with cream) is fitted into the surface of the base member 36. The base member 36 is provided with an arm portion 38 at both end portions. One of the arm portions 38 is provided with a cantilever-type leaf spring 39 on a surface facing the other of the arm portions 38. As shown in FIGS. 6(*a*) and 6(*b*), the base member 36 and the shaving aid 37 are arranged behind the razor head 2. The base member 36 is supported via both arm portions 38 at both end portions of the razor head 2 so as to rotatable about the axial line 38*a*. Therefore, the shaving aid member 35 is swingable against an elastic force of the leaf spring 39 in a thickness direction of the razor head 2 (Z direction).

Figure 8A:
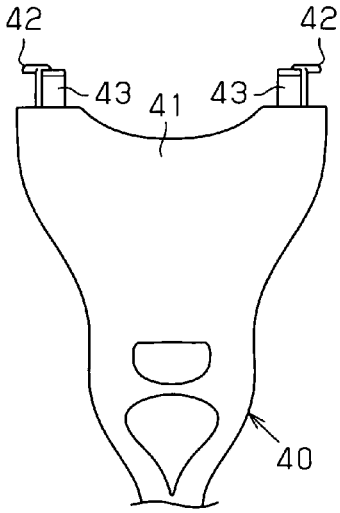
FIG. 8(*a*) is an enlarged partial plan view showing the head of the holder of the oscillating razor.
Figure 8B:
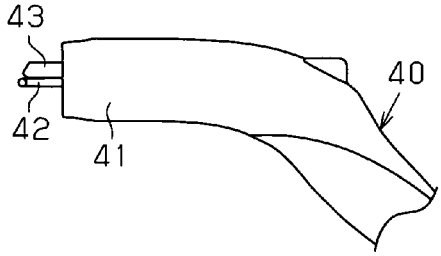
Figure 9A:
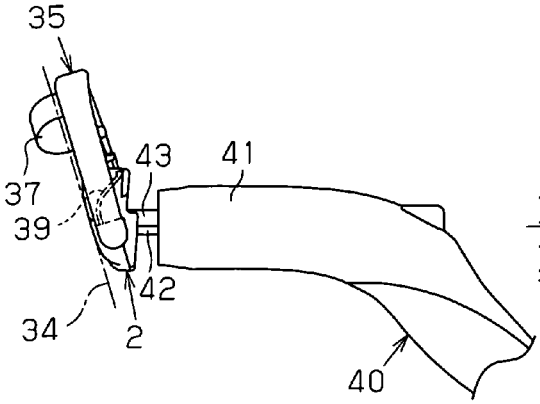
FIG. 9(*a*) is a partial side elevational view showing a state in which the razor head is mounted on the holder.
Figure 9B:
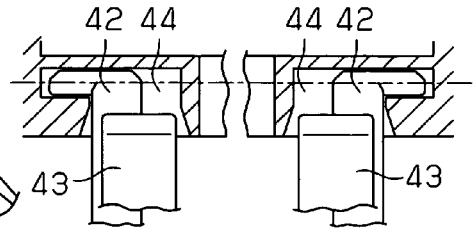

As shown in FIGS. 8(*a*) and 8(*b*), the holder 40 is provided with a head 41. A supporting arm 42 and a pusher 43 are projected as arm portions from both side portions of the head 41. As shown in FIGS. 9(*a*) and 9(*b*), the bottom base 22 of the blade base member 5 is provided with recesses 44 as supporting portions on the back sides of the left and right frame portions 24*c*, 24*d*. The debris discharge hole 25 is disposed between the recesses 44. In a state where each of the supporting arms 42 is arranged at each of the recesses 44 and a wall surface of each supporting arm 42 is pressed by each pusher 43, the razor head 2 is detachably supported to the head 41 of the holder 40. The razor head 2 swings against an elastic force of both pushers 43, together with the shaving aid member 35, with both supporting arms 42 used as supporting points.

The oscillating razor 1 is retained on a wall surface via a hook 45 shown in FIG. 1(*a*), when not in use. The hook 45 is provided with a suction cup 46 for adhering on a wall surface or the like and a cover 45*a* for preventing the razor head 2 from being splashed with water. The oscillating razor 1 is retained in a state where the head 41 of the holder 40 is hooked on the hook 45 to accommodate the razor head 2 inside the cover 45*a*.

When the skin-surface contact portion 33 of the top member 6 contacts the skin surface together with each of the blade bodies 4, while the oscillating razor 1 is in use, each of the leaf springs 9 deflects against a pressing force from each of the blade bodies 4, thereby allowing the blade body 4 to move. As shown in FIGS. 5(*a*) and 5(*b*), a clearance G between the blade body attaching plate 14 and both stoppers 24*e* is preferably set in a range of 0.1 mm to 1.2 mm. In the present embodiment, since the clearance G is set to be 0.5 mm, the blade body attaching plate 14 is movable in the Z direction only by the distance of the clearance G. Then, the blade body attaching plate 14 is brought into contact with both stoppers 24*e*, by which the movement of each of the blade bodies 4 is restricted (refer to FIG. 3(*b*)). It is preferable that on application of a force of 80 gf to 140 gf to the blade body attaching plate 14 in the Z direction orthogonal to the shaving tangential plane 34, the blade body 4 moves only by about 0.3 mm and on application of a force of 110 gf to 170 gf, the blade body 4 moves only by about 0.5 mm.

Debris made by each of the blade bodies 4 are taken into the debris discharge hole 18 via the front opening 20 of the blade member 3 and then discharged via the back opening 19 from the debris discharge hole 25 of the blade base member 5.

In addition, the present embodiment may be modified as follows.

The holder may be formed integrally with the bottom base of the razor head.

The skin-surface contact portion may be disposed on the blade base member, not on the top member. Further, one of a pair of skin-surface contact portions disposed on the top member may be omitted, and the skin-surface contact portion may be disposed on the blade base member.

The leaf spring may be disposed not only on both edges of the placing base but also on both ends of the placing base.

Further, the leaf springs on both edges of the placing base may be removed, and disposed on both ends of the placing base.

In place of the leaf spring, an elastic body such as a coil spring or rubber may be used.

A plurality of rods (for example, square rods, round rods, and odd-form rods) may be arrayed in a lattice form, and both ends of each rod may be bent to form a base.

The leg plate of each of the leaf springs may be changed in width and thickness, so that the leaf springs are adjusted for spring constant. Further, leaf springs different in spring constant may be used to make different a distance at which each blade body can move.

The cutting edge may be provided not only on the front side edge of each blade body but also at the back side edge. In this instance, the cutting edge at the back side edge of each blade body may be exposed.

The inclination direction of each step plate may be different between the front part and the back part of the blade body attaching plate. For example, each of the blade bodies may be arranged so that the cutting edge is inclined forward at the front part of the blade body attaching plate and also exposed at the blade body exposure hole of the top member, whereas the cutting edge is inclined backward at the back part of the blade body attaching plate and also exposed at the blade body exposure hole of the top member.

The number of blade bodies may be changed to five, six or eight. In this instance, a predetermined number of blade bodies are arranged at the front part of the blade body attaching plate and a remaining number of the blade bodies are arranged at the back part of the blade body attaching plate. The blade body attaching plate may be divided into two parts on the front side and the back side, and assembled.

The invention claimed is:

1. A razor provided with a razor head, comprising:

a top member arranged on a top side of the razor head;

a blade base member arranged on a bottom side of the razor head;

a blade member fitted between the blade base member and the top member, the blade member including a base and a plurality of blade bodies;

wherein cutting edges respectively provided on each of the plurality of blade bodies are exposed in the top member, wherein the blade member is an integral and unitary structure including the base, the plurality of blade bodies, and a blade body supporting portion that including a placing base and elastic bodies for elastically supporting the base on the blade base member, wherein the placing base is placed on the blade base member, and the blade body supporting portion is arranged between the elastic bodies, so that the base moves in response to force pressing against a skin surface when the plurality of blade bodies contacts the skin surface, wherein the elastic bodies respectively include a spring, and the blade body supporting portion is formed integrally with the elastic bodies, wherein the blade body supporting portion is provided with a plurality of blade body attaching portions arranged in a staircase pattern in a front-back direction, and each one of the plurality of blade bodies is attached to and movably integral with a respective one of the blade body attaching portions, and wherein the plurality of blade bodies are provided with a supporting plate that extends in a longitudinal direction of the plurality of blade bodies, leg plates that respectively bend from both end portions of the supporting plate toward the blade base member, and a space disposed between the supporting plate and the leg plates. *

2. The razor according to claim 1, wherein a skin surface contact portion that contacts the skin surface together with the cutting edges of the plurality of blade bodies are disposed on a surface of the razor head, each of the plurality of blade bodies is arranged on the base along the front-back direction, which is orthogonal to the longitudinal direction of the plurality of blade bodies.

3. The razor according to claim 2, further comprising:

a front skin surface contact portion, which is located on a front side of the plurality of blade bodies, and a back skin surface contact portion, which is located on a back side of the plurality of blade bodies, wherein the front and back skin surface contact portions are spaced apart from one another in the front-back direction, and wherein the base is movable in a direction orthogonal to a plane that includes the front and back skin surface contact portions.

4. The razor according to claim 1, wherein the spring of the elastic bodies includes a leaf spring.

5. The razor according to claim 1, wherein the plurality of blade bodies is attached to the blade body supporting portion by welding.

6. The razor according to claim 1, wherein the blade base member is provided with a base plate on which the base is placed, and the base plate is made of a metal higher in ionization tendency than the base or the plurality of blade bodies.

7. The razor according to claim 1, wherein the plurality of blade bodies is attached to the blade body supporting portion between the elastic bodies.

* * * * *